US009940818B2

(12) United States Patent
Heo

(10) Patent No.: US 9,940,818 B2
(45) Date of Patent: Apr. 10, 2018

(54) METHOD FOR CONTROLLING MOBILE PHONE LOSS PREVENTION FUNCTION BY MEANS OF BLUETOOTH EARPHONES

(71) Applicant: Mobifren Co., Ltd, Gumi-si, Gyeongsangbuk-do (KR)

(72) Inventor: Joo Won Heo, Gumi-si (KR)

(73) Assignee: MOBIFREN CO., LTD, Gyeongsangbuk-do (KR)

( * ) Notice: Subject to any disclaimer, the term of this patent is extended or adjusted under 35 U.S.C. 154(b) by 0 days.

(21) Appl. No.: 15/541,043

(22) PCT Filed: Oct. 26, 2016

(86) PCT No.: PCT/KR2016/012082

§ 371 (c)(1),
(2) Date: Jun. 30, 2017

(87) PCT Pub. No.: WO2017/074021

PCT Pub. Date: May 4, 2017

(65) Prior Publication Data

US 2017/0358198 A1 Dec. 14, 2017

(30) Foreign Application Priority Data

Oct. 27, 2015 (KR) ..... 10-2015-0149526

(51) Int. Cl.
*G08B 21/00* (2006.01)
*G08B 21/24* (2006.01)
(Continued)

(52) U.S. Cl.
CPC ..... *G08B 21/24* (2013.01); *G08B 3/10* (2013.01); *G08B 25/001* (2013.01); *G08B 25/10* (2013.01)

(58) Field of Classification Search
CPC ..... G08B 21/24; G08B 3/10; G08B 25/10
(Continued)

(56) References Cited

U.S. PATENT DOCUMENTS 6,885,848 B2 * 4/2005 Lee ..... H04M 1/6066 379/114.01
8,467,770 B1 * 6/2013 Ben Ayed ..... H04L 63/107 455/41.1
2015/0078574 A1 * 3/2015 Shin ..... H04R 1/1091 381/74

FOREIGN PATENT DOCUMENTS

JP 2005-150826 A 6/2005
KR 10-2001-0049035 A 6/2001
(Continued)

OTHER PUBLICATIONS

International Search Report dated Jan. 25, 2017 corresponding to International Application No. PCT/KR2016/012082.

*Primary Examiner* — Tai T Nguyen
(74) *Attorney, Agent, or Firm* — Hauptman Ham, LLP

(57) ABSTRACT

The present invention relates to a method for controlling a mobile phone loss prevention function by means of Bluetooth earphones. The method includes: a link loss determination step (S10) of measuring a sensitivity of a signal transmitted/received between a mobile phone and the Bluetooth earphone and determining occurrence of a link loss; warning sound generation steps (S20, S40, and S60) of, when the link loss has occurred, generating a warning sound, which warns of loss of the mobile phone, through the Bluetooth earphone in such a manner as to amplify a volume of the warning sound from a low volume to a high volume for each step; and warning sound stop identification steps (S30, S50, and S70) of determining whether a warning sound stop button has been operated by a user who has
(Continued)

recognized the warning sound and selecting whether the generation of the warning sound is to be stopped.

3 Claims, 2 Drawing Sheets

(51) Int. Cl.
*G08B 3/10* (2006.01)
*G08B 25/00* (2006.01)
*G08B 25/10* (2006.01)

(58) Field of Classification Search
USPC ..... 340/686.6, 539.32, 540, 541
See application file for complete search history.

(56) References Cited

FOREIGN PATENT DOCUMENTS

| | | | |
|---|---|---|---|
| KR | 10-0353215 | B1 | 9/2002 |
| KR | 10-2008-0091565 | A | 10/2008 |
| KR | 10-2012-0008555 | A | 2/2012 |
| KR | 10-1246990 | B1 | 3/2013 |

* cited by examiner

METHOD FOR CONTROLLING MOBILE PHONE LOSS PREVENTION FUNCTION BY MEANS OF BLUETOOTH EARPHONES

CROSS-REFERENCE TO RELATED APPLICATIONS

This application is a National Phase Application of PCT International Application No. PCT/KR2016/012082, which was filed on Oct. 26, 2016, and which claims priority from Korean Patent Application No. 10-2015-0149526 filed with the Korean Intellectual Property Office on Oct. 27, 2015. The disclosures of the above patent applications are incorporated herein by reference in their entirety.

TECHNICAL FIELD

The present invention relates to a method for controlling a mobile phone loss prevention function by means of Bluetooth earphones, and more particularly, to the provision of a method for controlling a mobile phone loss prevention function by means of Bluetooth earphones which is configured to determine the occurrence of a link loss between a Bluetooth earphone and a mobile phone and to generate a warning sound and a voice guide, which warn of the loss of the mobile phone through the earphone, for each volume step, and thereby, enables a user to recognize a warning and to rapidly cope with a loss state in a state where the user wears or does not wear the earphone.

BACKGROUND ART

Typically, a Bluetooth earphone is configured to wirelessly transmit/receive a voice signal to/from a terminal apparatus, such as a mobile phone or the like, on the basis of Bluetooth communication technology, and thus provides convenience, such as the removal of inconvenience caused by a cable connection configuration of an earphone. Accordingly, the use frequency of the Bluetooth earphone has been gradually on the rise.

Various controls required for the transmission/reception of a voice by a Bluetooth earphone can be mostly achieved by only the operation of the earphone that a user wears in his/her ear, and thus, the user typically keeps a mobile phone in a place, such as a bag or the like, distant from his/her body. However, in this case, a serious problem arises in that the user easily forgets the location of the mobile phone and thus, an incident of loss of the mobile phone frequently occurs.

According to the recognition of the above-mentioned problem, a product including a Bluetooth earphone having a mobile phone loss prevention function has recently been developed and provided. As an example, a configuration of a loss prevention apparatus and control method of a mobile phone using Bluetooth communication, which are known in Patent Registration No. 10-0353215, will be briefly described below.

A control method for preventing loss of a mobile phone in the mobile phone and an earphone which perform wireless communication by using Bluetooth communication includes: periodically measuring, by the mobile phone, a power level of a radio frequency received from the earphone; detecting a call state between the mobile phone and the earphone; transmitting a warning sound generation data to the earphone when a power level value of the radio frequency received from the earphone is less than or equal to a preset predetermined level value of the earphone in a state where the call state between the mobile phone and the earphone is detected; generating, by the earphone, a warning sound when the warning sound generation data is received from the mobile phone while performing Bluetooth wireless communication with the mobile phone; and generating, by only the mobile phone, a warning sound when the power level value of the radio frequency received from the earphone is less than or equal to the preset predetermined level value of the earphone in a state where the call state between the mobile phone and the earphone is not detected.

DETAILED DESCRIPTION OF THE INVENTION

Technical Problem

The loss prevention apparatus and control method of the mobile phone using Bluetooth communication, to which the above-described prior art is applied, have a form which allows a Bluetooth apparatus to generate a warning sound notifying of the occurrence of a link loss when a power level value of a radio frequency between the mobile phone and the earphone is less than or equal to a predetermined level.

However, the above-described prior art is implemented to allow a user to hear a warning sound (a small beep sound) only in a state of wearing the earphone or to generate a warning sound through the mobile phone. Accordingly, the above-described prior art is problematic in that the effectiveness thereof cannot be expected in a state where the user does not wear the earphone or has already lost the mobile phone, and in that a method capable of identifying whether the user has recognized a warning sound does not exist at all.

Meanwhile, a Bluetooth earphone to which a vibration motor is mounted is provided in a form which allows the vibration motor to operate and replace a warning sound differently from a warning sound generation scheme as in the registered patent described as an example. However, there is a limitation in that this configuration cannot be applied to a small model, such as a sports-type Bluetooth earphone to which a recently-released vibration motor is not mounted.

Technical Solution

In accordance with an aspect of the present invention, a method for controlling a mobile phone loss prevention function by means of Bluetooth earphones is provided. The method includes: a link loss determination step (S10) of measuring a sensitivity of a signal transmitted/received between a mobile phone and the Bluetooth earphone and determining occurrence of a link loss; warning sound generation steps (S20, S40, and S60) of, when the link loss has occurred, generating a warning sound, which warns of loss of the mobile phone, through the Bluetooth earphone in such a manner as to amplify a volume of the warning sound from a low volume to a high volume for each step; and warning sound stop identification steps (S30, S50, and S70) of determining whether a warning sound stop button has been operated by a user who has recognized the warning sound and selecting whether the generation of the warning sound is to be stopped.

Also, the warning sound generation steps (S20, S40, and S60) include: a first warning sound generation step (S20) of generating a warning sound at a low volume in an audible range when the user wears the earphone; a second warning sound generation step (S40) of generating a warning sound at a middle volume in an audible range when the user wears or does not wear the earphone; and a third warning sound generation step (S60) of generating a warning sound at a high volume in an audible range when the user does not wear the earphone.

Also, whenever the first to third warning sound generation steps (S20, S40, and S60) are performed, first to third warning sound stop identification steps (S30, S50, and S70) are successively performed, wherein the third warning sound stop identification step (S70) includes operating the warning sound stop button by the user, or identifying whether a predetermined time period has passed and automatically stopping the warning sound.

Also, the warning sound generation steps (S20, S40, and S60) further include first to third voice guide steps (S20', S40', and S60') of announcing a voice warning message after the generation of the warning sound, and thereby generate a voice warning message by amplifying the voice warning message from a low volume to a high volume for each step so as to be equivalent to the warning sound, or announce the voice warning message at a low volume.

Further, the warning sound stop button is configured such that the user sets and operates an optional button or a particular button included in the Bluetooth earphone. Therefore, it is possible to finally achieve an objective that the user can recognize a warning sound for each step in a state of wearing or not wearing the earphone and rapidly coping with an incident of loss of the mobile phone.

Advantageous Effects

According to the present invention, a determination is made of the occurrence of a link loss between a mobile phone and a Bluetooth earphone for which a wireless connection with the mobile phone has been established, and a warning sound is generated through the Bluetooth earphone, so that a user can recognize the warning sound and can prevent an incident of loss of the mobile phone.

Particularly, a warning sound generated through the earphone is configured such that the volume thereof is amplified from a low volume to a high volume for each step, so that the user can recognize the warning sound not only in a state of wearing the earphone but also in a state of not wearing the earphone. Also, reliability and convenience can be further improved by adding a separate warning sound stop identification step so as to prevent a warning sound from disturbing the use of the earphone simultaneously with identifying whether the user has recognized the warning sound.

Further, a Bluetooth earphone including a voice prompt function is configured to announce a warning message through a voice together with a warning sound, so that an effect of preparing a more user-friendly warning guide system can be expected.

BEST MODE FOR CARRYING OUT THE INVENTION

Figure 1:
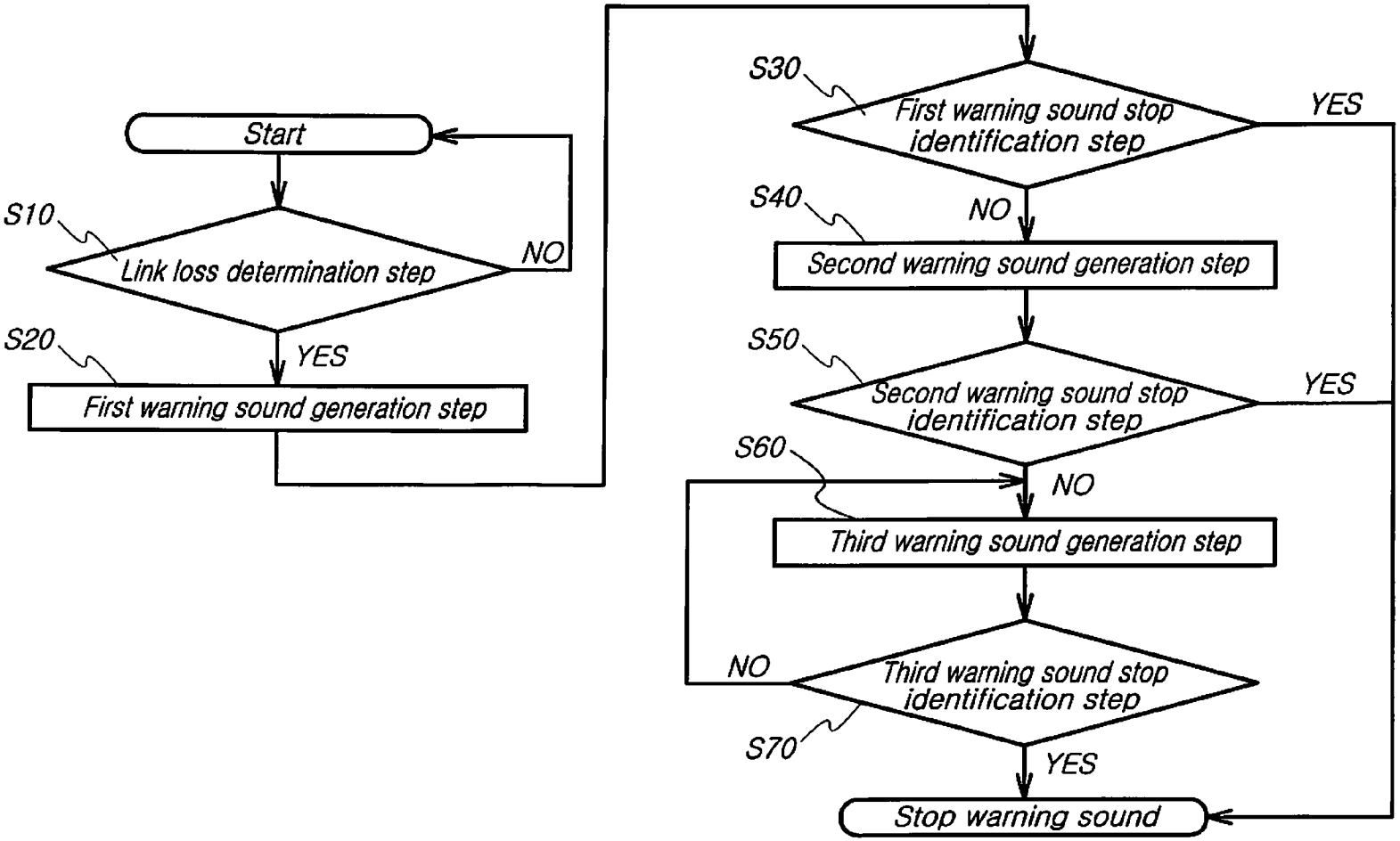
FIGS. 1 and 2 are flowcharts each illustrating an operation process according to an embodiment of a method for controlling a mobile phone loss prevention function by means of Bluetooth earphones according to the present invention.

It is noted that the present invention provides a method for controlling a mobile phone loss prevention function by means of Bluetooth earphones, to which the art of the present invention is applied, is configured to generate a warning sound and a voice guide through the Bluetooth earphone for each volume step when a link loss between the Bluetooth earphone and a mobile phone has occurred, and thereby, enables a user to recognize a mobile phone loss warning and to rapidly cope with a loss state in a state where the user wears or does not wear the earphone.

To this end, the method according to the present invention includes: a link loss determination step S10 of measuring a sensitivity of a signal transmitted/received between a mobile phone and the Bluetooth earphone and determining occurrence of a link loss; warning sound generation steps S20, S40, and S60 of, when the link loss has occurred, generating a warning sound, which warns of loss of the mobile phone, through the Bluetooth earphone in such a manner as to amplify a volume of the warning sound from a low volume to a high volume for each step; and warning sound stop identification steps S30, S50, and S70 of determining whether a warning sound stop button has been operated by a user who has recognized the warning sound and selecting whether the generation of the warning sound is to be stopped.

In the link loss determination step S10, an electrical strength of a signal transmitted/received between the mobile phone and the Bluetooth earphone is measured, wherein a case where the signal becomes smaller and is less than or equal to a predetermined reference value is determined as a link loss state, that is, a connection leaving state, and the mobile phone is assumed to be in danger of loss thereof.

When the occurrence of a link loss has been identified in the link loss determination step S10 as described above, in the warning sound generation step, a warning sound, for example, a beep sound, is generated through the Bluetooth earphone and a user is notified of a loss warning.

The warning sound generation steps S20, S40, and S60 include: a first warning sound generation step S20 of generating a warning sound at a low volume in an audible range when the user wears the earphone; a second warning sound generation step S40 of generating a warning sound at a middle volume in an audible range when the user wears or does not wear the earphone; and a third warning sound generation step S60 of generating a warning sound at a high volume in an audible range when the user does not wear the earphone.

In the present invention, the warning sound generation steps S20, S40, and S60 are configured to be performed three times, but it is well-known that the warning sound generation steps may be performed twice (high-pitched sound and low-pitched sound) or may also increase four times or more in stages.

Also, whenever the first to third warning sound generation steps S20, S40, and S60 are performed, first to third warning sound stop identification steps S30, S50, and S70 are successively performed, wherein the third warning sound stop identification step S70 includes operating the warning sound stop button by the user, or identifying whether a predetermined time period has passed and automatically stopping the warning sound.

That is, in a state where the user wears the Bluetooth earphone, a warning sound is generated at a low volume in the first warning sound generation step S20; in a state where the user wears or does not wear the Bluetooth earphone, a warning sound is generated at a middle volume in the second warning sound generation step S40; and thus, a volume is set and generated to enable the user to effectively recognize the warning sound while minimizing damage to the user's hearing.

Accordingly, the user who has recognized the warning sound in the first and second warning sound generation steps S20 and S40 for each step stops the warning sound by operating a warning sound stop button in the first and second warning sound stop identification steps S30 and S50, and identifies and copes with a loss state of the mobile phone.

Also, in the third warning sound generation step S60, a warning sound having a higher volume than in the previous steps is generated in view of the state where the user does not wear the earphone, so as to enable the user to recognize the warning sound. When the user has recognized the warning sound, the third warning sound stop identification step S70 allows the user to operate the warning sound stop button, or allows the warning sound to be automatically stopped when a determined time period passes. Accordingly, the occurrence of a problem caused by the continuation of the warning sound can be prevented.

As noted above, in an exemplary embodiment of the present invention, the warning sound generation steps S20, S40, and S60 and the warning sound stop identification steps S30, S50, and S70 are applied in such a manner as to be divided into three steps. However, it goes without saying that it is also possible to make a change to various configurations such as further subdivision of a configuration of each step and the like.

Also, it is desirable that the warning sound stop button, which is operated by the user in the warning sound stop identification steps S30, S50, and S70, is configured such that the user sets and operates an optional button or a particular button included in the Bluetooth earphone and thereby provides the user with stable operability in an unexpected situation.

Meanwhile, the warning sound generation steps S20, S40, and S60 further include first to third voice guide steps S20', S40', and S60' of announcing a voice warning message after the generation of the warning sound, and thereby generate a voice warning message by amplifying the voice warning message from a low volume to a high volume for each step so as to be equivalent to the warning sound.

This configuration is based on the understanding of the fact that a Bluetooth earphone having a voice prompt function typically provides a function of announcing, through a voice message, an operating state of the earphone, a Bluetooth communication establishment state, or the like.

Accordingly, in the first to third voice guide steps S20', S40', and S60', a warning message is announced in a voice after the generation of a warning sound, such as a beep sound; and thereby, a problem that a warning sound is offset by ambient noise or other voice information can be compensated for, and a user-friendly guide system can be prepared.

Also, in configuring the warning sound generation steps S20, S40, and S60, a voice warning message may be announced after a warning sound including a beep sound as described above, but the warning sound may be generated after the voice warning message is announced.

Mode for Carrying Out the Invention

A method for controlling a mobile phone loss prevention function by means of Bluetooth earphones according to the art of the present invention will be described in more detail with reference to embodiments of the present invention.

As illustrated in FIG. 1, in a link loss determination step S10, after a connection establishment between a mobile phone and a Bluetooth earphone is achieved, the sensitivity of an electrical signal transmitted/received between the mobile phone and the Bluetooth earphone is measured, a determination is made of whether a link loss has occurred, and a determination is made of whether the mobile phone has been lost.

In a first warning sound generation step S20, when the occurrence of the link loss has been determined in the link loss determination step S10, the Bluetooth earphone generates a first warning sound having a low volume on the assumption of a state where a user wears the earphone.

Then, in a first warning sound stop identification step S30, a determination is made of whether a warning sound stop button included in the earphone has been operated by the user, and the warning sound is stopped when the button has been operated, wherein, when the button is not operated while an optionally-determined predetermined time period, for example, 3 seconds, or more passes, a second warning sound generation step S40 is performed.

In the second warning sound generation step S40, on the assumption that the user is in a state of wearing or not wearing the earphone and does not recognize the warning sound, a second warning sound, which has a middle volume higher than in the first warning sound generation step S20, is generated.

Then, in a second warning sound stop identification step S50, a determination is made of whether the warning sound stop button included in the earphone has been operated by the user, and the warning sound is stopped when the button has been operated, wherein, when the button is not operated while an optionally-determined predetermined time period, similarly, 3 seconds, or more passes, a third warning sound generation step S60 is performed.

In a third warning sound generation step S60, on the assumption that the user is in a state of not wearing the earphone and does not recognize the warning sound, a third warning sound, which has a high volume higher than in the second warning sound generation step S40, is generated.

Then, in a third warning sound stop identification step S70, a determination is made of whether the warning sound stop button included in the earphone has been operated by the user, when the button is not operated while 3 seconds or more passes, the process returns to the third warning sound generation step S60 again, and sequentially and repeatedly performs the following steps. When the button is operated or when the button is not operated while an optionally-determined time period, for example, 1 minute, or more passes, the warning sound is stopped and a final warning is released.

Figure 2:
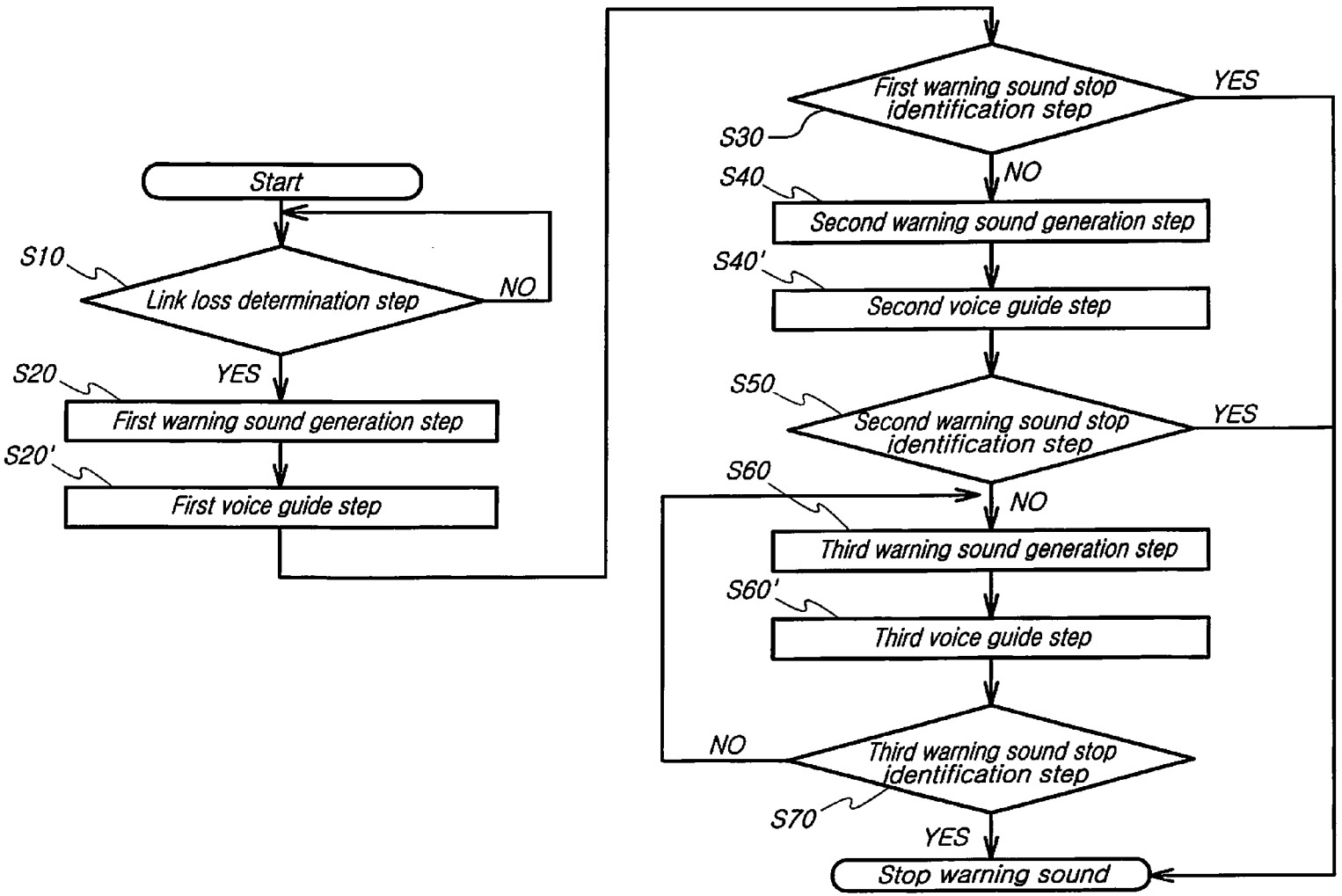

Meanwhile, in the case of a Bluetooth earphone having a voice prompt function, as illustrated in FIG. 2, a configuration may also be implemented to add first to third voice guide steps S20', S40', and S60' respectively following first to third warning sound generation steps S20, S40, and S60.

Industrial Applicability

Accordingly, the above-described method for controlling a mobile phone loss prevention function by means of Bluetooth earphones according to the present invention prepares the warning sound generation steps S20, S40, and S60 implemented in multiple steps, and the warning sound stop identification steps S30, S50, and S70 for identifying whether a user has recognized a warning sound, and thus can further improve the reliability of the mobile phone loss prevention function.

Particularly, the method allows the volume of a warning sound, which is generated through the earphone, to be amplified and generated for each step, and allows the user to recognize the warning sound not only in a state of wearing the earphone but also in a state of not wearing the earphone. Accordingly, the method can not only provide the convenience and stability of use of the earphone, but can also be applied to a miniaturized Bluetooth earphone to which a recently-released vibration motor is not mounted. Also, the method can be implemented to announce a warning message in a voice, and thus, it is possible to expect various effects, such as preparation of a more user-friendly warning guide system and the like.

The invention claimed is:

1. A method for controlling a mobile phone loss prevention function by means of Bluetooth earphones, the method comprising:

a link loss determination step of measuring a sensitivity of a signal transmitted/received between a mobile phone and the Bluetooth earphone and determining occurrence of a link loss;

warning sound generation steps of, when the link loss has occurred, generating a warning sound, which warns of loss of the mobile phone, through the Bluetooth earphone in such a manner as to amplify a volume of the warning sound from a low volume to a high volume for each step; and warning sound stop identification steps of determining whether a warning sound stop button has been operated by a user who has recognized the warning sound and selecting whether the generation of the warning sound is to be stopped, wherein the warning sound generation steps comprise:

a first warning sound generation step of generating a warning sound at a low volume in an audible range when the user wears the earphone, a second warning sound generation step of generating a warning sound at a middle volume in an audible range when the user wears or does not wear the earphone, and a third warning sound generation step of generating a warning sound at a high volume in an audible range when the user does not wear the earphone, wherein, whenever the first to third warning sound generation steps are performed, first to third warning sound stop identification steps are successively performed, and wherein the third warning sound stop identification step comprises operating the warning sound stop button by the user, or identifying whether a predetermined time period has passed and automatically stopping the warning sound.

2. The method as claimed in claim 1, wherein the warning sound generation steps further comprise first to third voice guide steps of announcing a voice warning message after the generation of the warning sound.

3. The method as claimed in claim 1, wherein the warning sound stop button is configured such that the user sets and operates an optional button or a particular button included in the Bluetooth earphones.

* * * * *